US008011888B1

(12) United States Patent
Liang

(10) Patent No.: US 8,011,888 B1
(45) Date of Patent: Sep. 6, 2011

(54) TURBINE BLADE WITH SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 398 days.

(21) Appl. No.: 12/426,240

(22) Filed: Apr. 18, 2009

(51) Int. Cl.
*F01D 5/08* (2006.01)

(52) U.S. Cl. ..... 416/92; 416/97 R

(58) Field of Classification Search ..... 416/92, 416/97 R, 97 A, 233
See application file for complete search history.

(56) References Cited

U.S. PATENT DOCUMENTS 6,247,896 B1 * 6/2001 Auxier et al. ..... 416/97 R
6,705,831 B2 * 3/2004 Draper ..... 415/115
6,932,571 B2 * 8/2005 Cunha et al. ..... 416/97 R

* cited by examiner

*Primary Examiner* — Chandra Chaudhari
(74) *Attorney, Agent, or Firm* — John Ryznic

(57) ABSTRACT

A turbine rotor blade with a first cooling circuit to provide cooling for the leading edge region of the airfoil and a suction side surface of the blade tip, and a second cooling circuit to provide cooling for the mid-chord region of the blade and the pressure side surface of the blade tip. The first cooling circuit includes a cooling air supply channel connected to a leading edge impingement cavity having showerhead arrangement of film cooling holes. The cooling air supply channel is connected to the suction side tip cooling channel that extends along the tip. The second cooling circuit includes a 3-pass forward flowing serpentine circuit with the third leg connected to a pressure side tip cooling channel that extends along the pressure side edge of the blade tip. Rows of tip cooling holes connect to both of the tip channels to discharge cooling air through the blade tip sections.

10 Claims, 5 Drawing Sheets

TURBINE BLADE WITH SERPENTINE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled blade in a gas turbine engine.

2. Description of the Related Art Including Information Disclosed Under 37 CFR 1.97 and 1.98

A gas turbine engine includes a turbine with multiple rows or stages of rotor blades that react with a high temperature gas flow to drive the engine or, in the case of an industrial gas turbine (IGT), drive an electric generator and produce electric power. It is well known that the efficiency of the engine can be increased by passing a higher temperature gas flow into the turbine. However, the turbine inlet temperature is limited to the material properties of the first stage vanes and blades and the amount of cooling that can be achieved for these airfoils.

In latter stages of the turbine, the gas flow temperature is lower and thus the airfoils do not require as much cooling flow. In future engines, especially IGT engines, the turbine inlet temperature will increase and result in the latter stage airfoils to be exposed to higher temperatures. To improve efficiency of the engine, low cooling flow airfoils are being studied that will use less cooling air while maintaining the metal temperature of the airfoils within acceptable limits. Also, as the TBC (thermal barrier coating) gets thicker, less cooling air is required to provide the same metal temperature as would be for a thicker TBC.

FIG. 1 shows a prior art turbine rotor blade with a 1+3 serpentine flow cooling circuit for the blade mid-chord serpentine cooling. The airfoil leading edge is cooled with a backside impingement cooling in conjunction with leading edge showerhead film cooling holes 11 and pressure side 12 and suction side 13 gill holes. Cooling air for the leading edge region is supplied through a separate radial supply channel 14 through a row of metering and impingement holes 15. FIG. 2 shows a flow diagram of the blade cooling circuit of FIG. 1. The airfoil main body is cooled with a triple pass (also referred to as a 3-pass) forward flowing serpentine circuit with a cooling air supply channel being the first leg 21, a second leg 22 and a third leg 23 in conjunction with pressure side 25 and suction 26 side film cooling holes and trailing edge discharge cooling holes 27. Blade tip cooling holes 28 are also used in both the leading edge cooling supply channel 14 and the 3-pass serpentine flow circuit to discharge some of the cooling air through the blade tip.

In the prior art, blade tip cooling is accomplished by drilling holes into the upper extremes of the serpentine coolant passages from both of the pressure and suction side surfaces near to the blade tip edge and the top surface of the squealer cavity or pocket. In general, film cooling holes are formed along the airfoil pressure side and suction side tip sections, from the leading edge to the trailing edge in order to provide edge cooling for the blade squealer tip. Also, convective cooling holes are also formed along the tip rail on the inner surface of the squealer pocket to provide additional cooling for the squealer tip rail. Since the blade tip region is subject to severe secondary flow field of hot gas flow, a large quantity of film cooling holes and cooling flow is required for cooling of the blade tip periphery. FIG. 3 shows a prior art blade with the tip edge film cooling holes 31 on the pressure side wall of the blade and FIG. 4 shows a detailed view of the film cooling hole 31 with its breakout shape. FIG. 5 shows the prior art blade with film cooling holes 32 on the suction side wall adjacent to the tip edge and FIG. 6 shows the breakout shape for the film hole 32. The hot gas vortex flow 35 is shown in FIG. 5 forming along the suction side wall at the trailing edge region of the blade.

For the prior art FIGS. 1 and 2 design, the last leg 23 of the 3-pass serpentine flow circuit is determined by the ceramic core manufacturing requirements. As a result of this cooling flow design requirement, when the cooling air is bled off from the cavity for cooling of both the pressure side and suction side walls and along the blade tip section, the spanwise internal Mach number of the cooling air flow becomes very low. A high Mach number for the cooling air flow will produce high heat transfers from the hot metal surface to the cooling air. This results in a lower flow through velocity and a cooling side internal heat transfer coefficient. The same flow phenomena can also be applied to the airfoil leading edge cooling supply channel.

BRIEF SUMMARY OF THE INVENTION

It is an object of the present invention to provide for a turbine blade with a serpentine flow cooling circuit having a high Mach number for improved internal cooling capability over the cited prior art turbine blade cooling circuit.

It is another object of the present invention to provide for a turbine rotor blade with a reduced metal temperature and a lower cooling air flow requirement than the cited prior art turbine rotor blade.

It is another object of the present invention to provide for a turbine rotor blade with a cooling circuit for the main body of the airfoil and leading and trailing edges that also provides cooling for the blade tip edge periphery.

The above objective and more are achieved with the cooling circuit for a rotor blade of the present invention which includes a first cooling air passage that provides cooling for the leading edge region and the peripheral edge of the suction side wall of the blade, and a second cooling air passage that provides cooling for the blade mid-chord region and the peripheral edge of the pressure side wall of the blade as well as the trailing edge region. The first passage includes a leading edge cooling supply channel connected to a leading edge impingement cavity through metering and impingement holes that connect to a showerhead arrangement of film cooling holes. Cooling air from the leading edge supply channel that does not flow into the impingement cavity flows through a suction side peripheral channel to discharge film cooling air onto the suction side wall on the suction side edge and through suction side tip cooling holes. Cooling air for the second passage flows through a 3-pass forward flowing serpentine circuit and then through a pressure side peripheral passage to provide cooling for the blade tip pressure side and to discharge cooling air through pressure side film holes along the pressure side periphery of the blade tip and through tip cooling holes along the pressure side of the blade tip. Cooling air from the first leg of the 3-pass serpentine circuit is bled off for use in cooling of the trailing edge region through a row of exit cooling holes along the trailing edge of the blade.

DETAILED DESCRIPTION OF THE INVENTION

Figure 1:
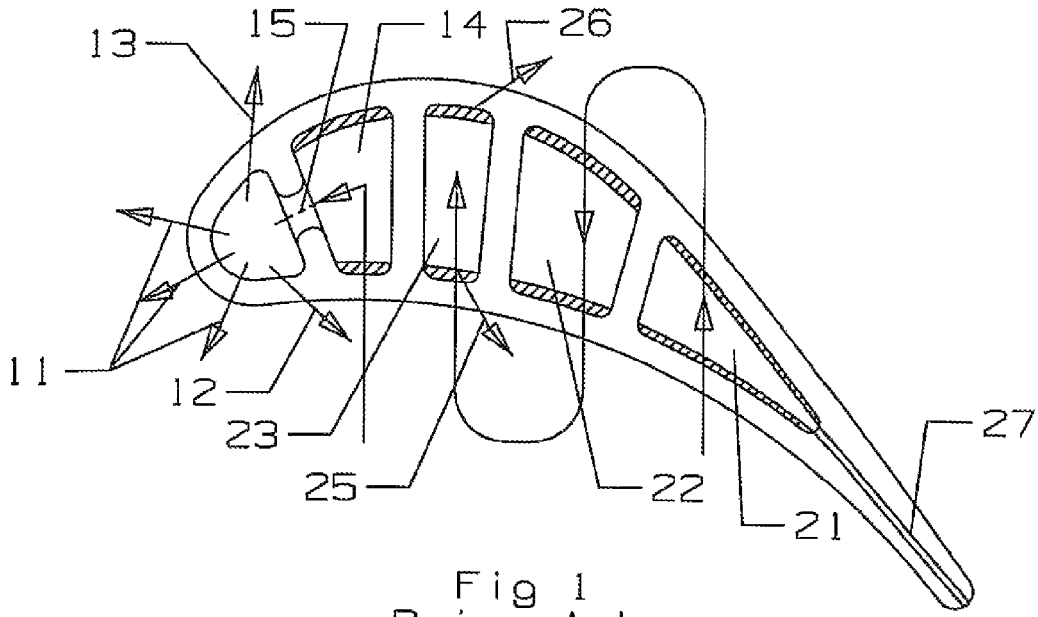
Fig 1 Prior Art
FIG. 1 shows a cross section top view of a prior art turbine rotor blade internal cooling circuit.
Figure 2:
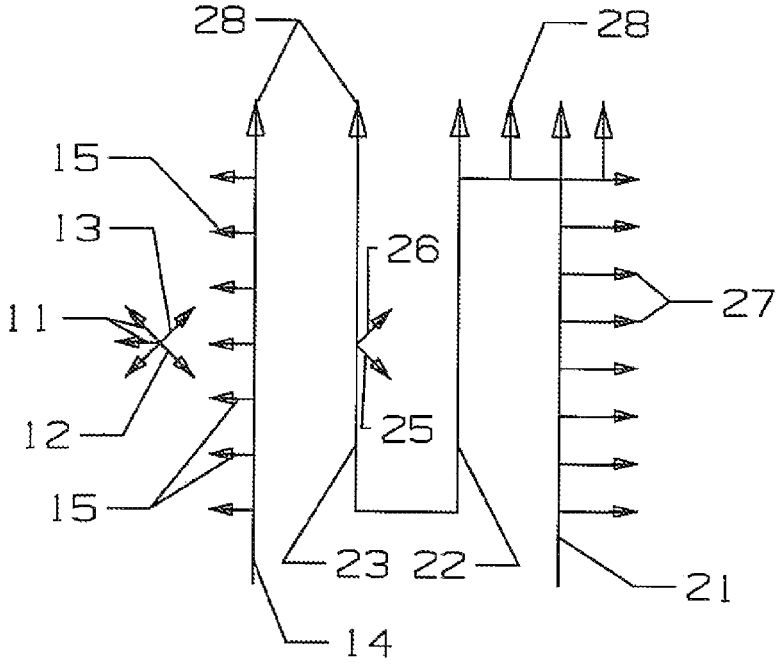
Fig 2 Prior Art
FIG. 2 shows a flow diagram of the prior art serpentine flow cooling circuit of FIG. 1.
Figure 3:
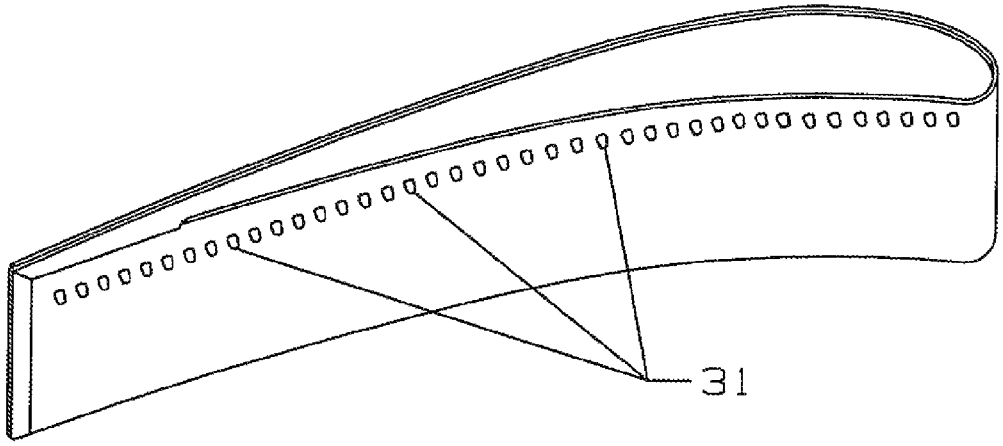
Fig 3 Prior Art
FIG. 3 shows the prior art turbine blade of FIG. 1 with pressure side tip peripheral cooling holes.
Figure 4:
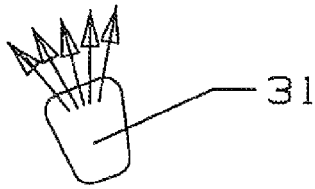
Fig 4 Prior Art
FIG. 4 shows a detailed view of the pressure side tip peripheral film cooling hole of FIG. 3.
Figure 5:
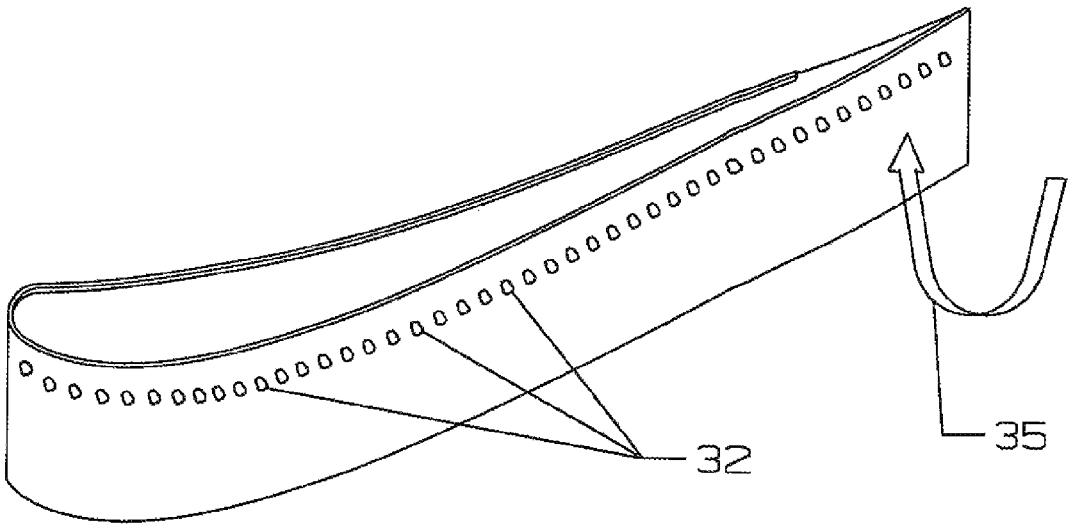
Fig 5 Prior Art
FIG. 5 shows the prior art turbine blade of FIG. 1 with suction side tip peripheral cooling holes.
Figure 6:
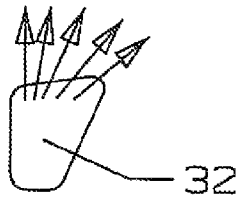
Fig 6 Prior Art
FIG. 6 shows a detailed view of the suction side tip peripheral film cooling hole of FIG. 5.
Figure 7:
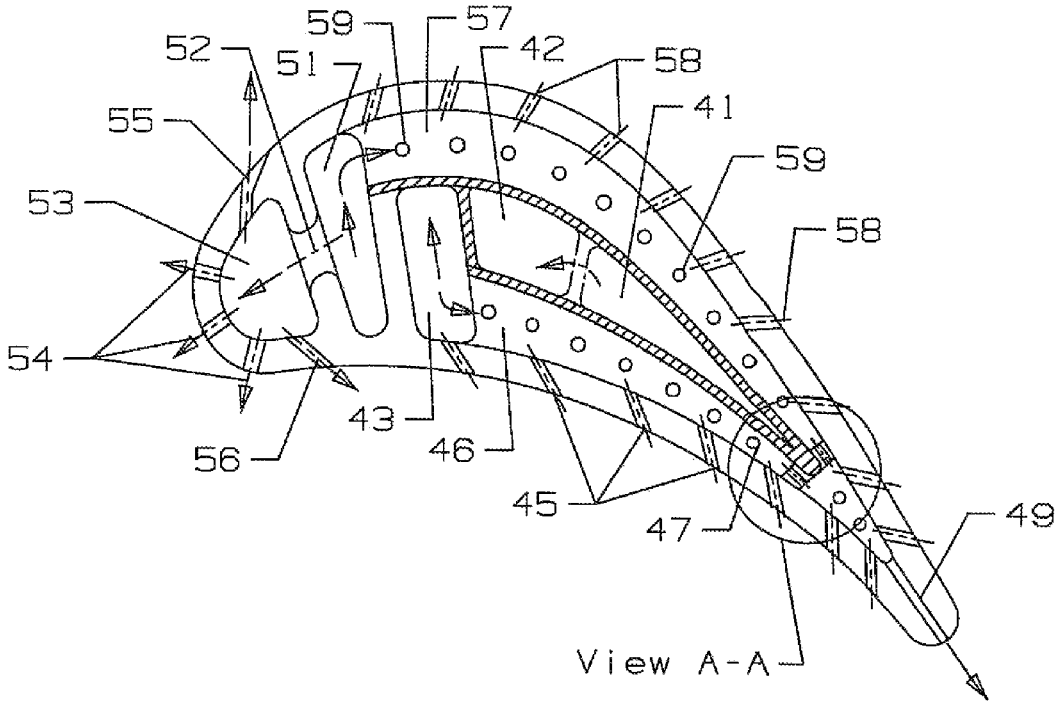
FIG. 7 shows a cross section top view of the internal cooling circuit for a turbine rotor blade of the present invention.

The turbine rotor blade with the cooling circuit of the present invention is intended for use as a blade in an industrial gas turbine engine, but could be used for an aero engine as well FIG. 7 shows a cross section view of the blade cooling circuit of the present invention along a spanwise direction of the blade. The blade includes a leading edge region with a cooling supply channel 51 extending from the root of the blade to the tip region and functions as a cooling air supply channel for the leading edge cooling circuit. The leading edge supply channel 51 is connected to a leading edge impingement cavity 53 through a row of metering and impingement holes 52 formed in a rib that separates the channel 51 from the cavity 53. The cavity extends from the root section of the blade to the tip region. In other embodiments, the cavity 53 can be formed as separate cavities that extend from the blade root to the tip region to provide impingement cooling for the entire leading edge backside surface of the blade.

A showerhead arrangement of film cooling holes 54 is connected to the leading edge impingement cavity 53 to discharge film cooling air. If desired, a row of gill holes on the pressure side 56 and the suction side 55 can also be connected to the cavity 53.

The leading edge cooling supply channel 51 also connects to a suction side tip cooling channel 57 that extends along the entire suction side wall of the blade tip to provide cooling to the suction side periphery of the blade tip. A row of suction side peripheral cooling holes 58 is connected to the channel 57 and extends along the entire suction side periphery of the blade tip edge. A row of suction side blade tip convection cooling holes 59 also connects the channel 57 and discharges cooling air through the holes in the blade tip.

Figure 8:
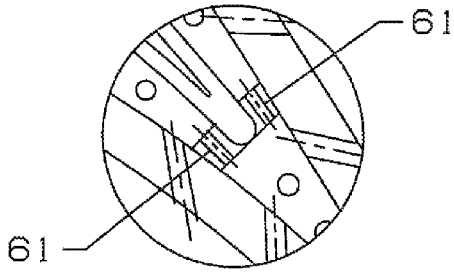
FIG. 8 shows a detailed view of the trailing edge section of the blade in FIG. 7.

The remaining sections of the blade are cooled by a 3-pass forward flowing serpentine cooling circuit with a first leg 41 operating as a cooling air supply channel and arranged adjacent to the trailing edge region of the blade. The first leg 41 extends from the root section to the blade tip section. A second leg 42 is located adjacent to the first leg 41, and a third leg 42 is located adjacent to the third leg 42 and adjacent to the leading edge region and the cooling supply channel 51. A row of trailing edge discharge cooling holes or slots 44 is connected to the first leg 41 or supply channel for the 3-pass serpentine circuit to provide cooling for the trailing edge region of the blade. The third and last leg 43 of the 3-pass serpentine circuit is connected to a pressure side tip cooling channel 46 that extends from the third leg 43 to the trailing edge corner of the blade tip. The pressure side tip cooling channel 46 is connected to a row of pressure side periphery film cooling holes 45 located just below the tip corner. A row of tip convection cooling holes 47 is also connected to the pressure side tip cooling channel 46 to discharge cooling air through the blade tip. As seen in FIGS. 7 and 8, the pressure side tip cooling channel 46 and the suction side tip cooling channel 57 both the tip channel cooling air through a metering and impingement cooling hole 61 and into a common trailing edge tip corner channel that then discharges through the trailing edge tip corner discharge hole 49. The metering and impingement cooling holes 61 are formed within a rib that extends across the tip cooling channel and can be sized such that the pressure in both tip cooling channels is equalized.

Figure 9:
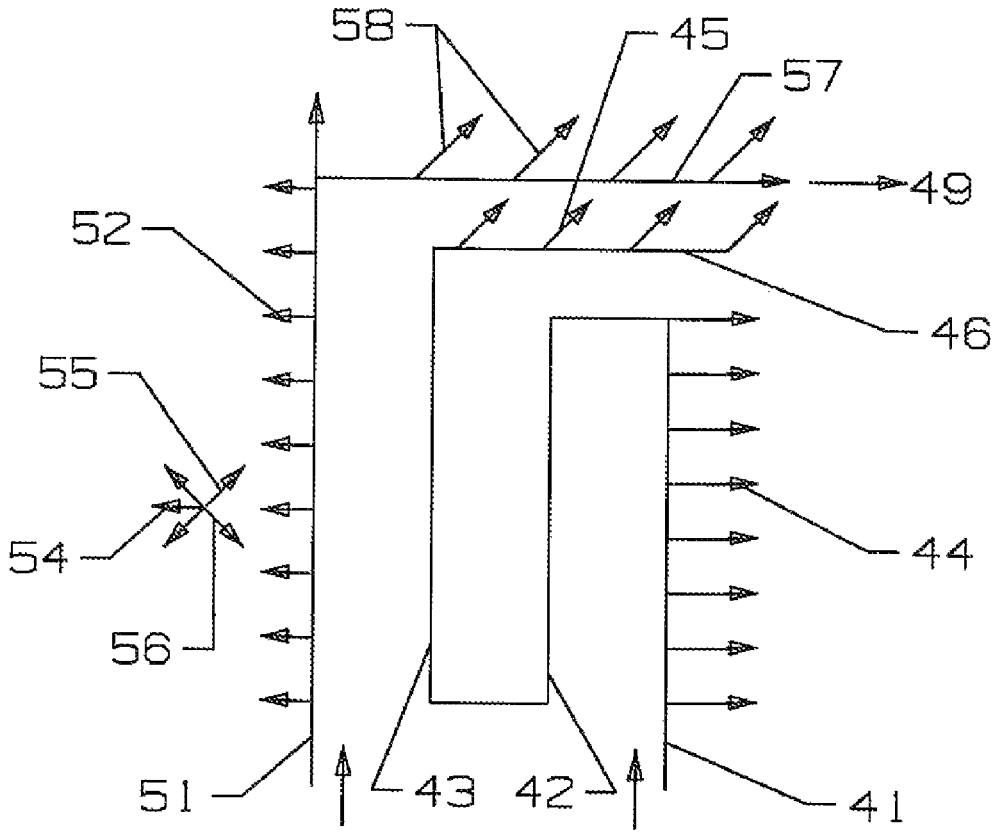
FIG. 9 shows a flow diagram for the blade cooling circuit of the present invention of FIG. 7.

FIG. 9 shows a flow diagram for the cooling circuits of the blade. The leading edge cooling air supply channel 51 and the impingement cavity 53 and the suction side tip cooling channel 57 form a first cooling circuit. The 3-pass forward flowing serpentine cooling circuit and the pressure side tip cooling channel 46 form a second cooling circuit in which cooling air from one cooling circuit does not mix with cooling air in the other cooling circuit until the two tip channels merge at the trailing edge corner of the airfoil through the metering and impingement cooling holes 61.

The cooling circuit of the present invention operates as follows. Pressurized cooling air, such as the compressed air from one of the stages of the compressor of the engine, is supplied to the leading edge cooling supply channel 51 and the first leg 41 of the 3-pass serpentine circuit. From the leading edge supply channel 51, the cooling air flows through the row of metering and impingement cooling holes 52 to provide impingement cooling to the backside surface of the leading edge wall of the blade. Some of the spent impingement cooling air in the impingement cavity 53 flows through the showerhead film cooling holes 54 and the gill holes 55 and 56 as film cooling air for the external surface of the leading edge region of the blade. The spent impingement cooling air not discharged through the film or gill holes then flows up and into the suction side tip cooling channel 57 to provide convection cooling for this section of the blade tip region. As the cooling air flows down the suction side tip channel 57, most of the cooling air will flow through the suction side peripheral cooling holes 58 and the tip convection cooling holes 59 to provide film cooling and convection cooling for these parts of the tip region.

The pressurized cooling air supplied to the first leg 41 of the 3-pass serpentine circuit will flow up toward the blade tip where some of the cooling air is bled off and through the row of trailing edge discharge holes 44 to provide cooling for the trailing edge region of the blade, the remaining cooling air then flows into the second leg 42 toward the root section and then into the third leg 43 toward the blade tip to provide convection cooling to this mid-chord region of the airfoil walls of the blade, the cooling air in the third leg 43 then flows into the pressure side tip cooling channel 46 to provide convection cooling to this region of the blade tip. As the cooling air flows down the pressure side tip channel 46, most of the cooling air will flow through the pressure side peripheral cooling holes 45 and the tip convection cooling holes 47 to provide film cooling and convection cooling for these parts of the tip region. The remaining cooling air from the suction side and pressure side tip cooling channels 57 and 46 is metered through the metering and impingement cooling holes 61 and then merges into a common trailing edge channel and then flow out from the tip through a tip corner trailing edge hole 44.

I claim the following:

1. An air cooled turbine rotor blade comprising:

an airfoil having an airfoil cross sectional shape with a leading edge and a trailing edge, and a pressure side wall and a suction side wall both extending between the two edges;

a leading edge cooling air supply channel positioned adjacent to a leading edge region of the airfoil;

a leading edge impingement cooling cavity located on the leading edge of the airfoil;

a row of metering and impingement holes connecting the leading edge cooling air supply channel to the leading edge impingement cooling cavity to provide impingement cooling to a backside surface of the leading edge of the airfoil;

a showerhead arrangement of film cooling holes connected to the leading edge impingement cooling cavity;

a suction side tip cooling channel connected to the leading edge cooling air supply channel and extending to the trailing edge of the airfoil;

a row of suction side tip cooling holes connected to the suction side tip cooling channel;

a forward flowing serpentine flow cooling circuit having a first leg located adjacent to a trailing edge region of the airfoil and a last leg located adjacent to the leading edge cooling air supply channel;

a pressure side tip cooling channel connected to the last leg of the serpentine flow cooling channel and extending to the trailing edge of the airfoil; and, a row of pressure side tip cooling holes connected to the pressure side tip cooling channel.

2. The air cooled turbine rotor blade of claim 1, and further comprising:

leading edge cooling air supply channel and the suction side tip cooling channel are fluidly separated from the forward flowing serpentine flow cooling circuit and the pressure side tip cooling channel such that cooling air from one cooling circuit does not mix with cooling air from the other circuit.

3. The air cooled turbine rotor blade of claim 1, and further comprising:

the suction side tip cooling channel and the pressure side tip cooling channel both connected to a common trailing edge tip corner channel through a metering and impingement cooling hole; and, a trailing edge discharge cooling hole connected to the common trailing edge tip corner channel to discharge the remaining cooling air from the two tip cooling channels.

4. The air cooled turbine rotor blade of claim 1, and further comprising:

the suction side tip cooling channel and the pressure side tip cooling channel both include a row of tip cooling holes.

5. The air cooled turbine rotor blade of claim 1, and further comprising:

the forward flowing serpentine flow cooling circuit is a 3-pass serpentine in which the three legs extend from the root section of the blade to the tip region.

6. The air cooled turbine rotor blade of claim 5, and further comprising:

the first and second legs of the 3-pass serpentine circuit are both formed between the suction side tip channel and the pressure side tip channel.

7. The air cooled turbine rotor blade of claim 1, and further comprising:

the suction side tip cooling channel and the pressure side tip cooling channel both are located underneath the blade tip such that convection cooling of the blade tip occurs due to cooling air flow through the two tip channels.

8. A process for cooling a turbine rotor blade, the blade including a leading edge region, a trailing edge region and a mid-chord region, and a pressure side blade tip section and a suction side blade tip section, the process comprising the steps of:

supplying a first cooling air flow to a leading edge region of the blade;

metering a portion of the first cooling air flow to provide impingement cooling for the leading edge of the airfoil;

discharging the spent impingement cooling air through film cooling holes to provide a layer of film cooling air for the leading edge of the airfoil;

passing the remaining first cooling air flow along the suction side blade tip section to provide convection cooling for the suction side blade tip section of the blade tip;

supplying a second cooling air flow to a trailing edge region of the airfoil;

bleeding off a portion of the second cooling air flow through the trailing edge region to provide convection cooling for the trailing edge region;

passing the remaining second cooling air flow through a series of serpentine passages toward the leading edge region; and, passing the remaining second cooling air flow through the pressure side blade tip section to provide convection cooling for the pressure side blade tip section of the blade tip.

9. The process for cooling a turbine rotor blade of claim 8, and further comprising the steps of:

discharging most of the cooling air flowing through the suction side blade tip section through tip cooling holes in the suction side tip section; and, discharging most of the cooling air flowing through the pressure side blade tip section through tip cooling holes in the pressure side tip section.

10. The process for cooling a turbine rotor blade of claim 9, and further comprising the steps of:

metering and impinging the remaining cooling air flow in the tip sections into a common trailing edge tip channel and then discharging the cooling air through the trailing edge tip corner.

* * * * *